US008858741B2

(12) United States Patent
Evans

(10) Patent No.: US 8,858,741 B2
(45) Date of Patent: Oct. 14, 2014

(54) METHODS FOR TREATING HIGH-STRENGTH, LOW-ALLOY STEEL

(75) Inventor: Edward B. Evans, Toronto (CA)

(73) Assignee: Goodrich Corporation, Charlotte, NC (US)

( * ) Notice: Subject to any disclaimer, the term of this patent is extended or adjusted under 35 U.S.C. 154(b) by 959 days.

(21) Appl. No.: 12/436,682

(22) Filed: May 6, 2009

(65) Prior Publication Data

US 2010/0282377 A1 Nov. 11, 2010

(51) Int. Cl.

| | |
|---|---|
| ***C21D 6/02*** | (2006.01) |
| ***C21D 1/58*** | (2006.01) |
| *C21D 6/04* | (2006.01) |
| *C21D 6/00* | (2006.01) |

(52) U.S. Cl.
CPC ... *C21D 1/58* (2013.01); *C21D 6/04* (2013.01)
USPC ..... 148/622; 148/578; 148/664

(58) Field of Classification Search
CPC ..... C21D 6/04; C21D 1/58
USPC ..... 148/578, 622, 664
See application file for complete search history.

(56) References Cited

U.S. PATENT DOCUMENTS

| | | | | |
|---|---|---|---|---|
| 3,873,378 | A * | 3/1975 | Webster | 148/325 |
| 4,296,512 | A * | 10/1981 | Kilinskas et al. | 470/16 |
| 2002/0017345 | A1 * | 2/2002 | Takashina et al. | 148/578 |

OTHER PUBLICATIONS

Paul Stratton; Cord Henrik Surberg; Retrained Austenite Stabilization in Carburized SAE 8620 Alloy Steel; Heat Treating Process, pp. 25-27, vol. 9, No. 2 Mar./Apr. 2009.

* cited by examiner

*Primary Examiner* — Keith D. Walker
*Assistant Examiner* — Alexander Polyansky
(74) *Attorney, Agent, or Firm* — Snell & Wilmer L.L.P.

(57) ABSTRACT

A method for treating high-strength, low-alloy steel includes controlling material responses, such as the crystal structure of the steel, through various processing steps. More specifically, the method includes cold treating the steel to achieve predictable increases in a minimum ultimate tensile strength or desired changes in the crystal structure of the steel. In one embodiment, cold treating the steel operates to controllably increase the minimum ultimate tensile strength of the steel within increasing a specified maximum ultimate tensile strength of the steel. Stated otherwise, cold treating the steel may reduce or narrow a minimum-to-maximum ultimate tensile strength range such that the minimum ultimate tensile strength is closer to the specified maximum ultimate tensile strength.

20 Claims, 2 Drawing Sheets

METHODS FOR TREATING HIGH-STRENGTH, LOW-ALLOY STEEL

FIELD OF THE INVENTION

This invention relates to methods for treating high-strength, low-alloy steel.

BACKGROUND OF THE INVENTION

There are various conventional methods for cold treating lower strength, higher alloy steels, such as the methods provided in the ASM Handbook Online, Volume 4 and those provided in U.S. Pat. No. 6,506,270. In addition, the affects on the crystal structure (i.e., microstructure or crystallographic structure) of steel after heat treating are generally well known in the art. In contrast, the affects of cold treating are discussed in the technical literature only with regard to low strength, high alloy steel, which may take the form of "tool steel." It is generally understood that there is no significant benefit to cold treating high-strength, low alloy steel.

SUMMARY OF THE INVENTION

A method for treating high-strength, low-alloy steel includes controlling material responses, such as the crystal structure of the steel, through various processing steps. More specifically, the method includes cold treating the steel to achieve predictable or desired increases in the heat treated steel crystal structure. The methods of cold treating the steel described herein provide the ability to selectively narrow a target strength range of the steel. More specifically, the methods for cold treating operate to increase a minimum ultimate tensile strength of the steel while maintaining the maximum ultimate tensile strength at its specified level and thereby not over-strengthening the steel.

In one embodiment, the process of increasing the minimum ultimate tensile strength may be accomplished repeatedly and in a controlled manner such that the increase of the minimum ultimate tensile strength is about one to about twenty kilopounds per square inch (KSI) relative to the specified maximum ultimate tensile strength. Stated otherwise or in addition, cold treating the steel may repeatedly and controllably achieve a desired crystal structure, which in turn may advantageously improve one or more physical properties of the steel to include, but not limited to, strength. By way of example, the process of cold treating steel may be used to increase the minimum ultimate tensile strength from about 280 to about 295 KSI while maintaining the maximum ultimate tensile strength at about the specified 305 KSI. Although many of the examples and embodiments herein may be directed to 300M steel, it is appreciated that the process of cold treating high-strength, low-alloy steel is applicable to a variety of steels having different properties and which may have different processing parameters, such as different processing temperatures, different quenching operations, etc.

In one example of the invention, a method for treating high-strength, low-alloy steel includes the steps of (1) austentizing the steel according to a selected material specification based on a type of steel being treated, the selected material specification providing a minimum and a maximum ultimate tensile strength for the type of steel; (2) quenching the steel; and (3) cold treating the steel within a desired temperature range to achieve a desired crystal structure of the steel, wherein the desired temperature range is about 70 degrees Fahrenheit above zero degrees Fahrenheit to about 110 degrees Fahrenheit below zero degrees Fahrenheit.

In another example of the invention, a method for treating high-strength, low-alloy steel includes the steps of (1) austentizing the steel according to a selected material specification based on a type of steel being treated, the selected material specification providing a minimum and a maximum ultimate tensile strength for the type of steel; (2) quenching the steel; and (3) increasing the minimum ultimate tensile strength to bring the minimum ultimate tensile strength closer to the maximum ultimate tensile strength by cold treating the steel within a desired temperature range to achieve a desired crystal structure of the steel.

BRIEF DESCRIPTION OF THE DRAWINGS

The preferred and alternative embodiments of the present invention are described in detail below with reference to the following drawings.

DETAILED DESCRIPTION OF THE PREFERRED EMBODIMENT

The following description generally relates to a method for achieving controlled strength increases in high-strength, low-alloy steel. In addition, the method for achieving the controlled strength increases may be used in aerospace and non-aerospace applications, such as, but not limited to, landing gear systems, assemblies, components, etc.

In the following description, certain specific details are set forth in order to provide a thorough understanding of various embodiments of the invention. However, one skilled in the art will understand that the invention may be practiced without these details. In other instances, well-known structures associated with aircraft, landing gear systems, assemblies and detailed components, and the operation thereof, and steel treatment processes have not necessarily been shown or described in detail to avoid unnecessarily obscuring descriptions of the embodiments of the invention.

In one embodiment, a method for treating high-strength, low-alloy steel includes cold treating (i.e., cooling) the steel after quenching from an austentizing temperature and before tempering the steel. The cold treating may occur within a desired temperature range from about 70 degrees Fahrenheit above zero (21 degrees Celsius) to about 110 degrees Fahrenheit below zero (−79 degrees Celsius). Thus, in some aspects the cold treating may be sub-zero cooling and may produce targeted and desired changes in the crystal structure of the steel, which may correspond to advantageous improvements in one or more physical properties of the steel, such as, but not limited to, increasing a minimum specified ultimate tensile strength (UTS) of the steel as described in greater detail below.

Figure 1:
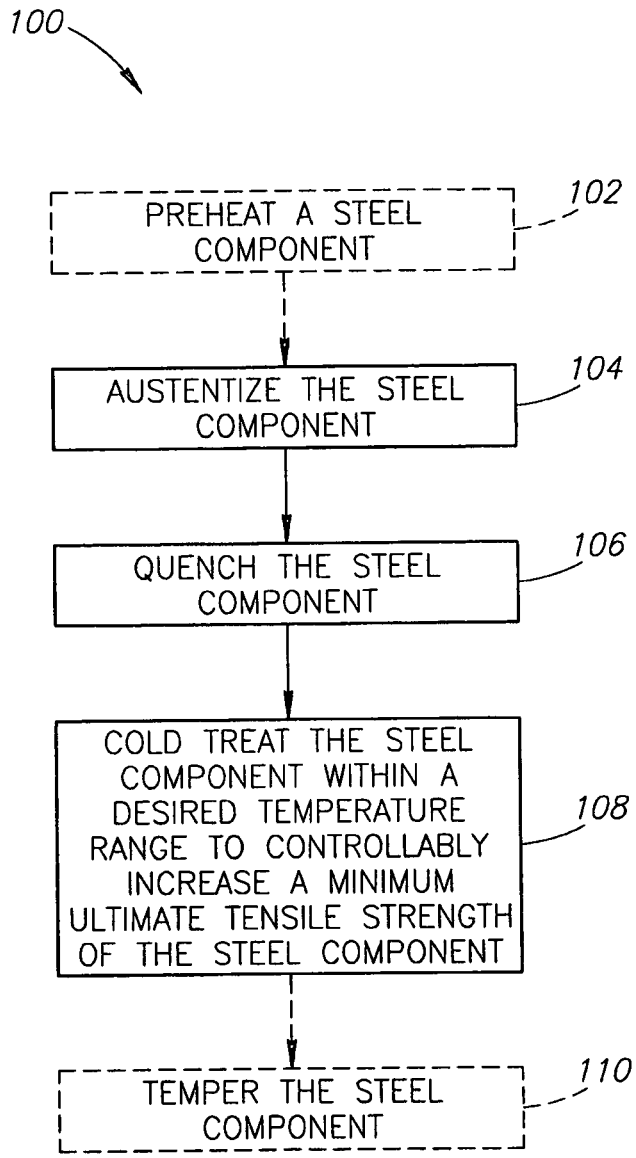
FIG. 1 shows a flow diagram for treating high-strength, low-alloy steel according to an embodiment of the present invention.

FIG. 1 shows a method 100 for treating high-strength, low-alloy steel according to an embodiment of the present invention. As a first optional process indicated as step 102, the steel may be pre-heated according to a selected material specification for the type of steel being treated. In one embodiment, the steel is pre-heated within a temperature range defined by Aerospace Material Specification (AMS) 2759/2 for heat treatment of high-strength, low-alloy steel parts having a minimum tensile strength of about 220 KSI (about 1517 megapascals (MPa)) and higher. The pre-heating temperature range may be about 900 to about 1200 degrees Fahrenheit (about 482 to about 649 degrees Celsius).

At step 104, the steel is austentized according to the selected material specification at an austentizing temperature determined by the steel being treated. In one embodiment, the steel is austentized at a temperature of about 1600 degrees Fahrenheit (about 871 degrees Celsius). At step 106, the steel is quenched according to the selected material specification. In one embodiment, the steel is oil quenched with the oil being approximately at an ambient temperature.

At step 108, the steel is cold treated within a desired temperature range. As noted, cold treating the steel occurs after quenching (step 106) from an austentizing temperature and before tempering (step 110) the steel. The cold treating may occur within a desired temperature range from about +70 degrees Fahrenheit (+21 degrees Celsius) to about −110 degrees Fahrenheit (−79 degrees Celsius). Accordingly, the cold treating may be sub-zero cooling and further may induce specific and desired changes in the crystal structure of the steel. By way of example, cold treating the steel within the desired temperature range may provide predictable and repeatable increases in the minimum specified ultimate tensile strength (UTS) of the steel to achieve a higher minimum UTS while maintaining the maximum specified UTS.

At step 110, the steel is tempered according to the selected material specification at a tempering temperature determined by the steel being treated. In one embodiment, the steel is tempered within a temperature range of about 450 degrees Fahrenheit to about 650 degrees Fahrenheit (about 232 degrees Celsius to about 343 degrees Celsius) for a desired amount of time. More specifically, tempering the steel may occur within at a temperature about 575 degrees Fahrenheit (about 302 degrees Celsius) for the desired amount of time.

Figure 2:
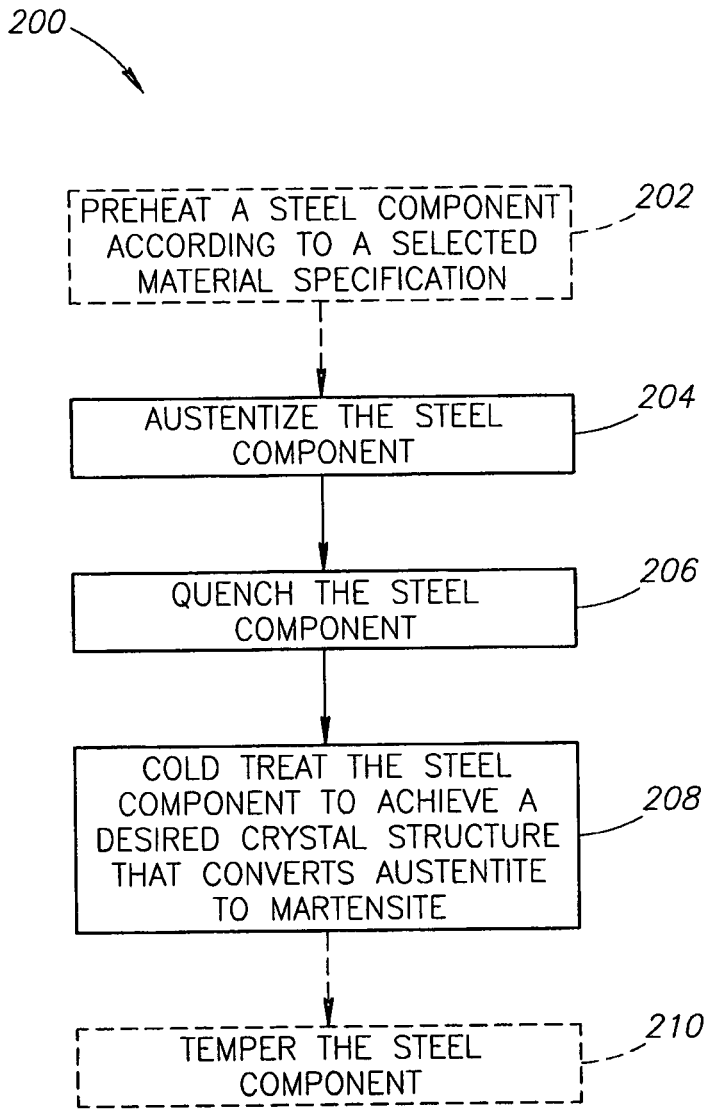
FIG. 2 shows a flow diagram for treating high-strength, low-alloy steel according to another embodiment of the present invention.

FIG. 2 shows a method 200 for treating high-strength, low-alloy steel according to another embodiment of the present invention. At optional step 202, the steel may be pre-heated according to a selected material specification for the steel being treated. At step 204, the steel is austentized and at step 206, the steel is quenched. Both previous steps are accomplished in accordance with the selected material specification for the steel being treated.

At step 208, the steel is cold treated within a desired temperature range to achieve a desired crystal structure that increases the minimum UTS of the steel. In one embodiment, cold treating the steel at the desired temperature range achieves a desired crystal structure by inducing an isothermal transformation of the crystal structure from a face-centered cubic structure (i.e., austentite) to a body-centered tetragonal structure (i.e., martensite). At step 210, the steel is tempered within a selected temperature range for a desired amount of time.

By way of another example, high-strength, low-alloy steel such as 300M may exhibit an increase in its minimum UTS that is inversely proportionate to the cold treatment temperature. Generally, a lower cold treating temperature provides a larger increase in the minimum UTS. Further, the cold treating may induce a progressive decrease in the percentage of the retained austenite phase in the crystal structure of the heat-treated 300M steel. Testing of the cold treating process has verified the inverse relationship in which the minimum UTS increases with the cold treatment temperature.

For example, testing indicated that cold treating from about 70 degrees Fahrenheit to about −110 degrees Fahrenheit produced an increase of approximately twelve KSI in the minimum UTS of 300M steel where the steel was otherwise heat treated per the requirements of AMS 2759/2. In addition, testing showed that results obtained when cold treating down to −110° F. was repeatable and could be controllably performed on steel components without adverse affects such as cracking or non-desired distortion.

In one embodiment, a method for cold treating 300M steel that previously failed to meet a 287 KSI minimum UTS includes cold treating the steel in a cold environment, such as a dry ice with methanol environment, a cooled fluid environment, or in a cooling cabinet environment after quenching. The cooled liquid may take the form of methanol, metered liquid nitrogen, or some other fluid that flows in a liquid form when at a temperature of around or about 110 degrees Fahrenheit below zero. The cold treating method may be used to predictably increase the minimum UTS by approximately 1-15 KSI. In the present example, the minimum UTS was for 300M steel was increased from 287 KSI to about 299 KSI using an embodiment of the method described herein. In addition, x-ray diffraction tests completed after the cold treatment process found the cold treated 300M steel had lower percentages of retained austenite as compared to before cold treating.

As briefly discussed above, the method of cold treating high-strength, low-alloy steel may be performed at a variety of temperatures from about +70 degrees Fahrenheit to about −110 degrees Fahrenheit. In one aspect, cold treating at temperatures above zero degrees Fahrenheit, like cold treating using ice water or by washing in cold water, may provide a sufficient increase in the minimum UTS while being less expensive and less cumbersome than using dry ice, a sub-zero liquid or some combination thereof.

The above-described methods for treating high-strength, low-alloy steel and correspondingly increasing the minimum UTS of the steel permits engineers to design steel components using the same type of steel, for example 300M steel, with thinner cross sections. This results in a component with reduced weight, which is desirable in a various different applications, especially aerospace. In addition, the above-described methods may produce predictable and repeatable increases in the minimum strength of the steel and/or desired changes in the crystal structure of the steel, either of which may permits engineers to utilize the same type of steel for different situation, such as higher load environments, more severe operating conditions, etc.

While the preferred embodiment of the invention has been illustrated and described, as noted above, many changes can be made without departing from the spirit and scope of the invention. Accordingly, the scope of the invention is not limited by the disclosure of the preferred embodiment. Instead, the invention should be determined entirely by reference to the claims that follow.

The embodiments of the invention in which an exclusive property or privilege is claimed are defined as follows:

1. A method for treating high-strength low-alloy steel, the method comprising:

austentizing high-strength low-alloy steel to provide a minimum and a maximum ultimate tensile strength for the steel;

quenching the steel; and cold treating the steel to a predetermined temperature to achieve a correlated predetermined crystal structure of the steel, wherein the predetermined temperature is in a range from about 70 degrees Fahrenheit above zero degrees Fahrenheit to about 110 degrees Fahrenheit below zero degrees Fahrenheit to produce a controlled increase in minimum ultimate tensile strength of the steel thereby avoiding over or under strengthening the steel.

2. The method of claim 1, further comprising pre-heating the steel for a predetermined amount of time.

3. The method of claim 1, wherein cold treating the steel at the desired temperature range to achieve the desired crystal structure includes inducing an isothermal transformation of the crystal structure from a face-centered cubic structure to a body-centered tetragonal structure.

4. The method of claim 1, wherein cold treating the steel includes raising the minimum ultimate tensile strength to a predetermined level that is correlated with the predetermined temperature.

5. The method of claim 1, wherein cold treating the steel includes placing the steel in an environment cooled by a fluid that flows in a liquid form when at a temperature of about 110 degrees Fahrenheit below zero.

6. The method system of claim 5, wherein cold treating the steel includes placing the steel in a dry ice with methanol environment.

7. The method of claim 1, wherein cold treating the steel includes increasing the minimum ultimate strength of the steel by about 1 to about 20 kilopounds per square inch.

8. The method of claim 1, wherein cold treating the steel at the desired temperature to achieve the desired crystal structure includes transforming residual austenite to a martensite.

9. The method of claim 2, wherein pre-heating the steel occurs within a temperature range of about 1200 to about 1600 degrees Fahrenheit.

10. The method of claim 1, wherein austentizing the steel occurs at a temperature of about 1600 degrees Fahrenheit.

11. The method of claim 1, wherein quenching the steel includes oil quenching.

12. The method of claim 1, further comprising tempering the steel.

13. The method of claim 12, wherein tempering the steel includes maintaining the steel within a temperature range of about 450 to 650 degrees Fahrenheit for a desired time.

14. The method of claim 13, wherein maintaining the steel within the temperature range includes maintaining the steel at a temperature of about 575 degrees Fahrenheit.

15. A method for treating high-strength low-alloy steel, the method comprising:

austentizing high-strength low-alloy steel to provide a minimum and a maximum ultimate tensile strength for the steel;

quenching the steel; and increasing the minimum ultimate tensile strength to bring the minimum ultimate tensile strength closer to the maximum ultimate tensile strength by cold treating the steel to a predetermined temperature to achieve a predetermined crystal structure of the steel that is correlated with the predetermined temperature to produce a controlled increase in minimum ultimate tensile strength of the steel thereby avoiding over or under strengthening the steel.

16. The method of claim 15, wherein increasing the minimum ultimate tensile strength includes increasing the minimum ultimate tensile strength by about 1 to about 20 kilopounds per square inch.

17. The method of claim 15, wherein the desired temperature range is about 70 degrees Fahrenheit above zero to about 110 degrees Fahrenheit below zero.

18. The method of claim 15, wherein cold treating the steel at the desired temperature range includes inducing an isothermal transformation of the crystal structure from a face-centered cubic structure to a body-centered tetragonal structure.

19. The method of claim 15, wherein bringing the minimum ultimate tensile strength closer to the maximum ultimate tensile strength includes maintaining the maximum ultimate tensile strength at about a constant level.

20. The method of claim 15, wherein cold treating the steel includes placing the steel in an environment cooled by a fluid that flows in a liquid form when at a temperature of about 110 degrees Fahrenheit below zero.

* * * * *